US009756918B1

(12) United States Patent
Fernandez

(10) Patent No.: US 9,756,918 B1
(45) Date of Patent: Sep. 12, 2017

(54) SHOULDER STRAP SYSTEM

(71) Applicant: Isabel Fernandez, Dallas, TX (US)

(72) Inventor: Isabel Fernandez, Dallas, TX (US)

( * ) Notice: Subject to any disclaimer, the term of this patent is extended or adjusted under 35 U.S.C. 154(b) by 0 days.

(21) Appl. No.: 14/946,779

(22) Filed: Feb. 4, 2016

(51) Int. Cl.

| | |
|---|---|
| ***A45C 13/00*** | (2006.01) |
| ***F16B 2/22*** | (2006.01) |
| ***A45C 13/30*** | (2006.01) |
| ***A45F 3/12*** | (2006.01) |

(52) U.S. Cl.
CPC ..... *A45C 13/001* (2013.01); *A45C 13/30* (2013.01); *A45F 3/12* (2013.01); *F16B 2/22* (2013.01)

(58) Field of Classification Search
CPC ..... A45F 3/12; Y10T 24/1394
USPC ..... 224/264
See application file for complete search history.

(56) References Cited

U.S. PATENT DOCUMENTS 3,710,391 A * 1/1973 McGlynn ..... A45F 3/12 224/264
5,983,407 A * 11/1999 McKay ..... A41D 13/0531 2/231

* cited by examiner

*Primary Examiner* — Robert J Sandy
(74) *Attorney, Agent, or Firm* — Richard G. Eldredge; Eldredge Law Firm

(57) ABSTRACT

A shoulder strap clip for a shoulder bag having a first strap and a second strap. The shoulder strap clip includes a shoulder padding configured to rest on a shoulder of a user; a spring-loaded clip rigidly attached to the shoulder padding at one end and configured to extend over a top surface of the shoulder padding. The spring-loaded clip includes a first contoured slot configured to receive the first strap of the shoulder bag; and a second contoured slot configured to receive the second strap of the shoulder bag.

2 Claims, 7 Drawing Sheets

SHOULDER STRAP SYSTEM

BACKGROUND

1. Field of the Invention

The present invention relates generally to systems that support an article carried by the shoulder and more specifically to shoulder strap attachments for bags, handbags, back packs, and purses.

2. Description of Related Art

Systems for carrying shoulder straps over the shoulder are well known in the art and are effective means, for example, for supporting the weight of an article, such as a handbag or purse, over a wearer's shoulder. In FIG. 1A, a system 100, comprising a conventional handbag 101, a first shoulder strap 103, and a second shoulder strap 105 is illustrated.

A common disadvantage with system 100 is that there is no padding to cushion the weight of handbag 101 when carried by the wearer's shoulder (not shown) via straps 103 and 105.

FIG. 1B shows a conventional shoulder strap system 102 comprising the handbag 101 and two shoulder pads 107 fixed to each of straps 103 and 105.

A common disadvantage associated with shoulder pad attachments 107 is that they do not prevent straps 103 or 105 from slipping off of the wearer's shoulder. The wearer must therefore raise her shoulder while carrying the handbag 101 to prevent slipping.

FIG. 1C shows a conventional shoulder strap system 104 comprising the handbag 101 and a single shoulder pad attachment 109 that wraps around straps 103 and 105.

A common disadvantage associated with shoulder pad attachment 109 is that it connects straps 103 and 105 such that ready access to the contents of the handbag 101 is limited. The wearer must then open or remove shoulder pad 109 to access the contents of the handbag 101.

It will be appreciated that the disadvantages described above are not only inconvenient but also increase the wearer's discomfort and fatigue when using the handbag 101. It will also be appreciated that shoulder pads 107 and 109 can be aesthetically unappealing. Further, it should be understood that conventional strap systems do not add accessory appeal.

Although great strides have been made in the area of systems for carrying shoulder straps, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
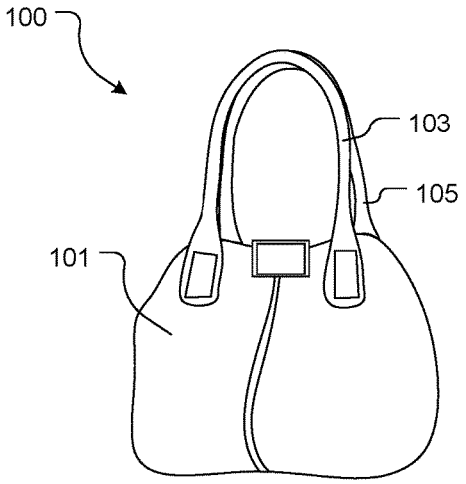
FIG. 1A (Prior Art)
FIGS. 1A, 1B, and 1C are front views of conventional shoulder strap carrying systems.
Figure 1B:
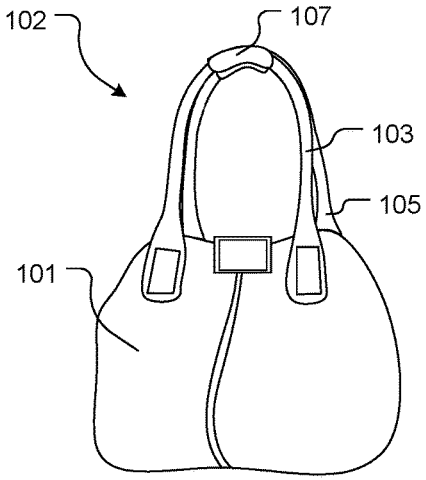
FIG. 1B (Prior Art)
Figure 1C:
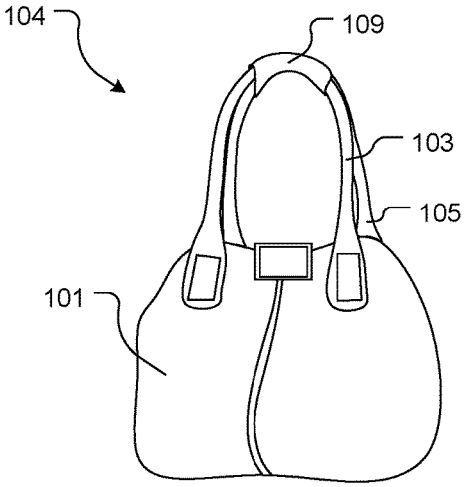
FIG. 1C (Prior Art)

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with shoulder strap carrying systems. Specifically, the system of the present application is configured to decrease the pressure and discomfort of carrying the weight of an item over one's shoulder by means of one or two shoulder straps. The system also preserves easy access to the contents of the carried item while decreasing the likelihood that either shoulder strap will slip from the shoulder. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 2:
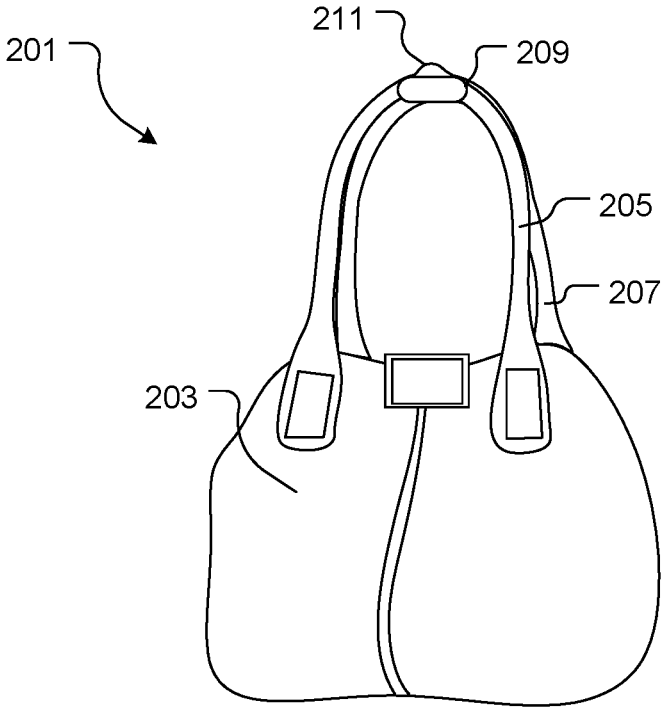
FIG. 2 is a front view of a shoulder strap carrying system in accordance with a preferred embodiment of the present application.

Referring now to the drawings wherein like reference characters identify corresponding or similar elements throughout the several views, FIG. 2 depicts a simplified front view of a shoulder strap carrying system 201 in accordance with a preferred embodiment of the present application. It will be appreciated that the system 201 overcomes one of more of the above-listed problems commonly associated with the conventional shoulder strap systems.

In the contemplated embodiment, system 201 includes a carried item 203 such as a handbag or purse carried by a first strap 205 and a second strap 207 over one's shoulder (not shown). A detachable clip 209 secures straps 205 and 207 while providing padding 211 between straps 205 and 207 and the shoulder. It is appreciated that the padding 211 of clip 209 reduces the pressure and discomfort to the wearer's shoulder from the weight of the carried item 203. Further, the features of system 201 provide sufficient anti-slip and aesthetically pleasing appearances. The combination of providing anti-slip, comfort, and aesthetically pleasing features sets the present system apart from current state of the art systems.

A unique feature of clip 209 is that it generally forms an "S" shape curvature such that strap 207 is secured under one curve of clip 209 and strap 205 is secured over the other curve of clip 209. This configuration enables the wearer to disengaged strap 205 from clip 209 to readily access the contents of the carried item 203 without removing or substantially altering the system 201. It is appreciated that the ability to readily engage or disengage strap 205 from clip 209 is convenient and can decrease the wearer's discomfort or fatigue. It is also appreciated that clip 209 carries an accessory appeal such that it is more likely to be considered aesthetically pleasing.

Figure 3:
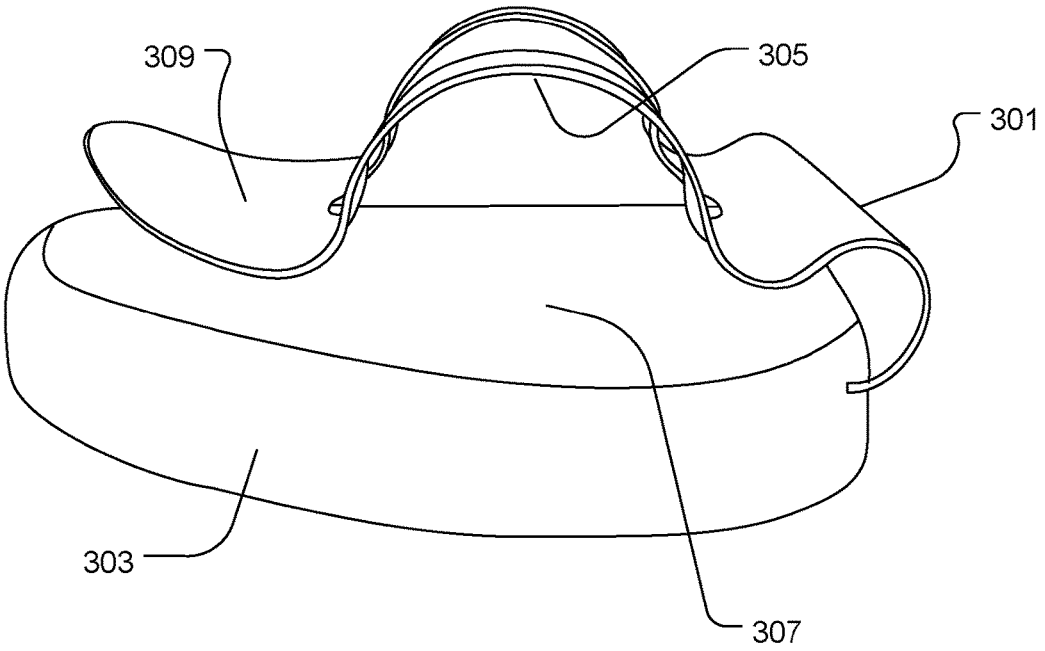
FIG. 3 is a side view of a detachable shoulder strap clip in accordance with the shoulder strap carrying system of FIG. 2.

Referring to FIG. 3, a side view of clip 209 is shown. As discussed, the clip 301 is attached to padding 303 and generally forms an "S" shape curvature 305 such that slots 307 and 309 occur wherein shoulder straps (not shown) can be secured below and above the curvature 305, respectively. It should be noted that although only one means for attaching clip 301 to padding 303 is shown that other embodiments, such as Velcro, a clip/clutch mechanism, buttons, or glue, are expressly contemplated herein.

Figure 4A:
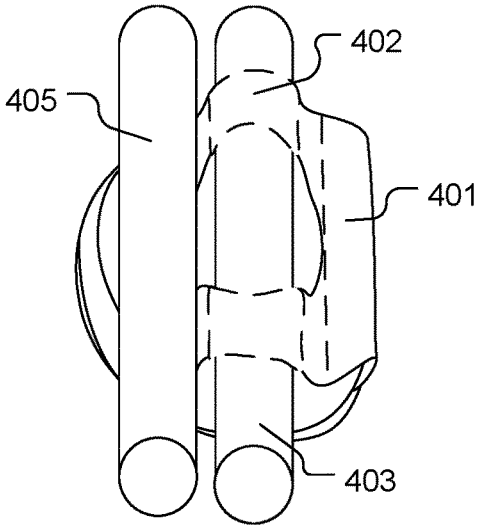
FIGS. 4A and 4B are top views of the detachable shoulder strap clip of FIG. 3.
Figure 4B:
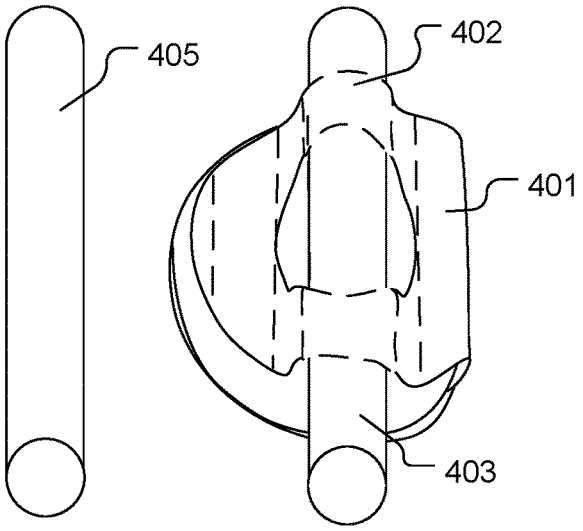

FIG. 4A shows a top view of clip 209 with both straps secured and FIG. 4B shows a top view of clip 209 with one strap disengaged. As discussed, the clip 401 secures a first strap 403 under the curvature 402 and the second strap 405 above the curvature 402.

Figure 5:
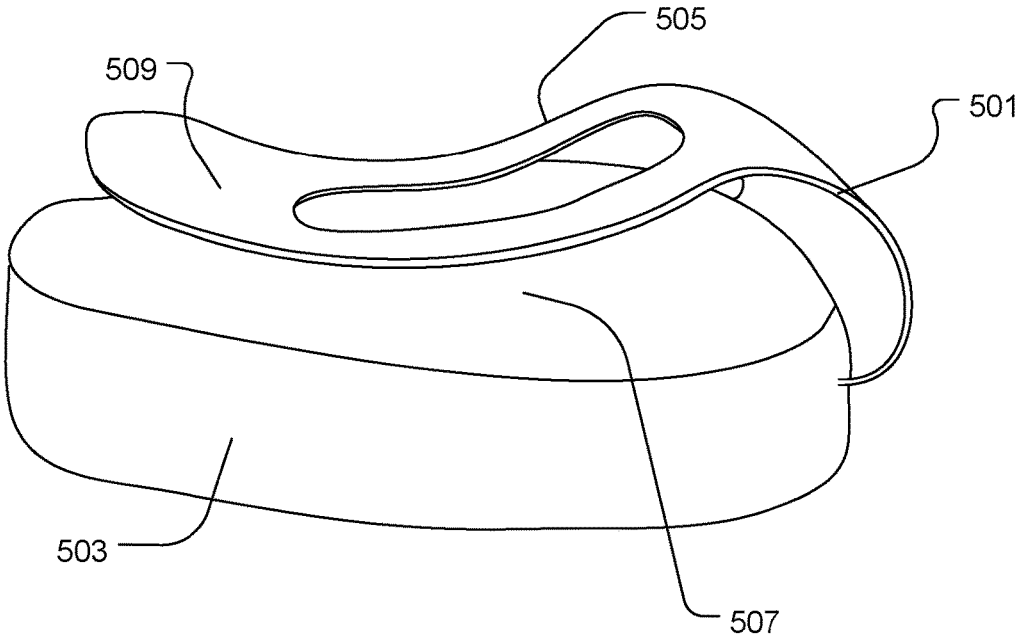
FIG. 5 is a side view of an alternative embodiment of the shoulder strap clip of FIG. 3.

Referring now to FIG. 5, a side view of an alternative embodiment of clip 209 is shown. Whereas previously discussed embodiments accommodate round or oval shoulder straps, the embodiment of FIG. 5 reduces the curvature of clip 209 to accommodate flat shoulder straps (not shown). As previously discussed (See FIG. 3), the clip 501 is attached to padding 503 and generally forms an "S" shape curvature 505 such that slots 507 and 509 occur wherein shoulder straps (not shown) can be secured below the curvature 505. Again, it should be noted that although only one means for attaching clip 501 to padding 503 is shown that other embodiments, such as Velcro, buttons, glue, or clip/clutch mechanisms are expressly contemplated herein.

Figure 6:
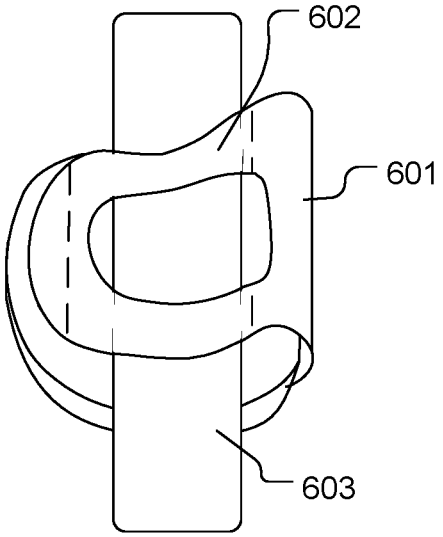
FIG. 6 is a top view of the detachable shoulder strap clip of FIG. 4.

FIG. 6B shows a top view of clip 501 with one strap disengaged. As discussed (See FIG. 4), the clip 601 secures a first strap 603 under the curvature 602 of the clip 601.

Figure 7:
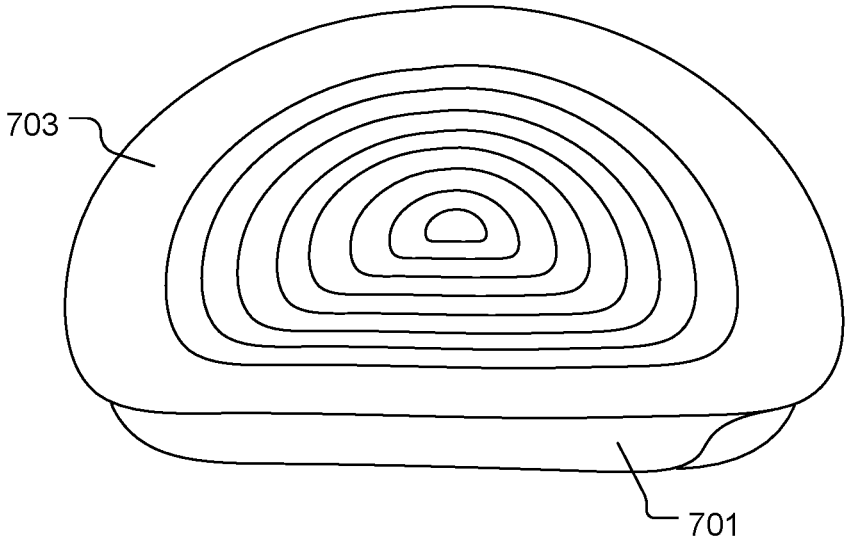
FIG. 7 is a bottom view of the detachable shoulder strap clip of FIG. 3.

FIG. 7 shows a bottom view of clip 209. In the contemplated embodiment the clip 701 is attached to padding 703 wherein the padding preferably comprises of a foam, polyurethane, or silicone material. It should be noted that alternative embodiments and materials of padding 703, such as contoured or ergonomic configurations, are expressly contemplated herein.

It is hereby reiterated that that the features discussed above provide the following advantages over conventional systems, specifically: (1) the system is lightweight and economical; (2) the system prevents slippage from the shoulders; (3) the system add comfort; and (4) the system adds accessory appeal. These factor combined give the present system a competitive advantage over the known systems.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A shoulder strap clip for a shoulder bag having a first strap and a second strap, the shoulder strap clip comprising:

a shoulder padding configured to rest on a shoulder of a user;

a spring-loaded clip rigidly attached to the shoulder padding at one end and configured to extend over a top surface of the shoulder padding, the spring-loaded clip forming an elongated body having a s-shaped curvature and having a first section integral with a second section, the spring-loaded clip having a top surface and a bottom surface, the spring-loaded clip, having:

the first section with a first contoured slot forming a curved arch with a first radius, the first contoured slot is configured to receive the first strap of the shoulder bag, the first section is configured to contact the first strap against the bottom surface and sandwich the first strap between the first contoured slot and the shoulder padding; and the second section with a second contoured slot forming a second curved arch with a second radius, the second contoured slot is configured to receive the second strap of the shoulder bag, the second section is configured to removably receive the second strap in the second curved arch formed by the second contoured slot, the second section is configured to hold the second strap against the top surface of the spring-loaded clip; and an opening extending through a thickness of the spring-loaded clip, the opening providing access to the first strap;

wherein the first radius of the first contoured slot and the second radius of the second contoured slot are equal in length;

wherein the second contoured slot comes into contact with a top surface of the shoulder padding; and wherein the second section provides easy and rapid disengagement of the second strap from the shoulder strap clip during use.

2. The shoulder strap clip of claim 1, further comprising:

a gripping contoured surface on a bottom surface of the shoulder padding;

wherein the bottom surface of the shoulder padding is configured to conform and rest on the shoulder of the user.

* * * * *